US005909948A

United States Patent [19]

Ellis, III

[11] Patent Number: 5,909,948

[45] Date of Patent: Jun. 8, 1999

[54] SHOE SOLE STRUCTURES

[76] Inventor: Frampton E. Ellis, III, 2895 S. Abingdon St., Suite B-2, Arlington, Va. 22206

[21] Appl. No.: 08/222,004

[22] Filed: Apr. 4, 1994

Related U.S. Application Data

[63] Continuation of application No. 07/608,748, Nov. 5, 1990, abandoned.

[51] Int. Cl.[6] ..... A43B 13/14

[52] U.S. Cl. ..... 36/102; 36/25 R

[58] Field of Search ..... 36/32 R, 59 C, 36/102, 28, 59 R, 31, 25 R; D2/320, 309, 310

[56] References Cited

U.S. PATENT DOCUMENTS

| | | | |
|---|---|---|---|
| D. 86,527 | 3/1932 | Klein | D2/320 |
| D. 115,636 | 7/1939 | Sperry | D2/320 |
| D. 278,851 | 5/1985 | Austin | D2/320 |
| D. 288,027 | 2/1987 | Tonkel | 36/32 R |
| 500,385 | 6/1893 | Hall | 36/102 |
| 2,155,166 | 4/1939 | Kraft | 36/59 C |
| 2,162,912 | 6/1939 | Craver | 36/59 C |
| 2,206,860 | 7/1940 | Sperry | 36/59 C |
| 2,251,468 | 8/1941 | Smith | 36/59 C X |
| 2,508,392 | 5/1950 | Issaly | 36/33 |
| 2,922,235 | 1/1960 | Meltzer | 36/33 |
| 4,527,345 | 7/1985 | Lopez Lopez | 36/32 R |
| 4,542,598 | 9/1985 | Misevich et al. | 36/114 |
| 4,557,059 | 12/1985 | Misevich et al. | 36/32 R |
| 4,777,738 | 10/1988 | Giese et al. | 36/32 R |
| 4,858,340 | 8/1989 | Pasternak | 36/30 R |
| 4,864,739 | 9/1989 | Maestri | 36/44 |
| 4,989,349 | 2/1991 | Ellis, III | 36/59 C |
| 5,012,597 | 5/1991 | Thomasson | 36/59 C |
| 5,247,742 | 9/1993 | Kilgore | 36/114 |
| 5,317,819 | 6/1994 | Ellis, III | 36/30 R |
| 5,544,429 | 8/1996 | Ellis, III | 36/114 X |

FOREIGN PATENT DOCUMENTS

| | | | |
|---|---|---|---|
| 1176458 | 10/1984 | Canada . | |
| 337366 | 11/1903 | France | 36/59 C |
| 825941 | 3/1938 | France | 36/59 C |
| 1034194 | 7/1953 | France | 36/59 C |
| 1290844 | 3/1969 | Germany | 36/32 R |
| 1590064 | 8/1990 | U.S.S.R. | 36/59 C |
| 471179 | 8/1937 | United Kingdom | 36/59 C |

*Primary Examiner*—Ted Kavanaugh
*Attorney, Agent, or Firm*—Finnegan, Henderson, Farabow, Garrett & Dunner, L.L.P.

[57] ABSTRACT

A construction for a shoe, specifically a shoe sole, particularly the structure of an athletic shoe sole. Still more particularly, this invention relates to a lateral stability sipe that allows any shoe sole to provide significantly improved lateral support to the foot. Still more particularly, this invention relates to the use of a lateral stability sipe in an athletic shoe sole to provide it with sufficient flexibility along a natural axis so as to allow the shoe heel to remain relatively flat under the foot heel even when most of the forefoot of the shoe is lifted off the ground when tilted out sideways to a maximum in natural supination motion.

14 Claims, 6 Drawing Sheets

SHOE SOLE STRUCTURES

This application is a continuation of application Ser. No. 07/608,748, filed Nov. 5, 1990, now abandoned.

BACKGROUND OF THE INVENTION

This invention relates generally to the structure of shoes, more specifically shoe soles. This invention relates particularly to the structure of athletic shoe soles. Still more particularly, this invention relates to a lateral stability sipe that allows any shoe sole to provide significantly improved lateral support to the foot. Still more particularly, this invention relates to the use of a lateral stability sipe in an athletic shoe sole to provide it with sufficient flexibility along a natural axis so as to allow the shoe heel to remain relatively flat under the foot heel even when most of the forefoot of the shoe is lifted off the ground when tilted out sideways to a maximum in natural supination motion.

The applicant has introduced into the art the use of sipes to provide natural deformation paralleling the human foot in pending U.S. application Ser. No. 07/424,509, filed Oct. 20, 1989 now abandoned, Ser. No. 07/478,579, filed Feb. 8, 1990 now abandoned, and Ser. No. 07/539,870, filed on Jun. 18, 1990 now abandoned. It is the object of this invention to elaborate upon a specific form of sipe discussed generally in those earlier applications to apply some of their general principles to other shoe sole structures, including those introduced in other earlier applications. PCT Application No. PCT/US90/06028, which is comprised verbatim of the '509 application and was published as WO 91/05491 on May 2, 1991; PCT Application No. PCT/US91/00720, which is comprised verbatim of the '579 application and was published as WO 91/11924 on Aug. 22, 1991; and PCT Application No. PCT/US91/04138, which is comprised verbatim of the '870 application and was published as WO 91/19429 on Dec. 26, 1991.

In addition to the prior pending applications indicated above, the applicant has introduced into the art the concept of a theoretically ideal stability plane as a structural basis for shoe sole designs. That concept as implemented into shoes such as street shoes and athletic shoes is presented in pending U.S. applications Ser. Nos. 07/219,387, filed on Jul. 15, 1988, now U.S. Pat. No. 4,989,349, issued Feb. 5, 1991; 07/239,667, filed on Sep. 2, 1988, now U.S. Pat. No. 5,317,819, issued Jun. 7, 1994; 07/400,714, filed on Aug. 30, 1989 now abandoned; 07/416,478, filed on Oct. 3, 1989 now abandoned; 07/463,302, filed on Jan. 10, 1990 now abandoned; and 07/469,313, filed on Jan. 24, 1990 now abandoned, as well as in PCT Application No. PCT/US89/03076 filed on Jul. 14, 1989, and subsequent PCT Applications filed by the applicant. PCT Application No. PCT/US89/03076, which is generally comprised of the virtually the entire '819 Patent verbatim (FIGS. 1–28) and major portions of the '349 Patent also verbatim (FIGS. 29–37) and was published as International Publication Numbers WO 90/00358 on Jan. 25, 1990; PCT Application No. PCT/US90/04917, which is comprised verbatim of the '714 application, except for FIGS. 13–15 (which were published as FIGS. 38–40 of WO 90/00358) and was published as WO 91/03180 on Mar. 21, 1991; PCT Application No. PCT/US90/05609, which is comprised verbatim of the '478 application and was published as WO 91/04683 on Apr. 18, 1991; PCT Application No. PCT/US91/00028, which is comprised verbatim of the '302 application and was published as WO 91/10377 on Jul. 25, 1991; PCT Application No. PCT/US91/00374, which is comprised verbatim of the '313 application and was published as WO 91/11124 on Aug. 8, 1991.

Accordingly, it is a general object of the new invention to elaborate upon the application of the principle of the lateral stability sipe to conventional shoe sole structures.

It is an overall objective of this application to show additional forms and variations of the lateral stability sipe invention, particularly showing its incorporation into the other inventions disclosed in the applicant's other applications.

These and other objects of the invention will become apparent from a detailed description of the invention which follows taken with the accompanying drawings.

BRIEF DESCRIPTION OF THE DRAWINGS

FIG. 1 shows that shoe when tilted 20 degrees outward, at the normal limit of ankle inversion.

FIG. 4 shows the foot upright with its sole flat on the ground; FIG. 4B shows a shoe sole of the same size when tilted out 20 degrees to the same position as FIG. 4A. The right foot and shoe are shown.

FIG. 6 is a top view of a conventional shoe sole with a corresponding outline of the wearer's footprint superimposed on it to identify the position of the lateral stability sipe relative to the wearer's foot. FIG. 6B is a cross section about the heel of the shoe sole with lateral stability sipe. FIG. 6C is a top view like FIG. 6, but showing the print of the shoe sole with a lateral stability sipe when it is tilted outward 20 degrees.

FIGS. 9 & 10 were taken early in the load-bearing phase of the running stride and FIGS. 11 & 12 were taken late in the same phase; FIGS. 9 & 11 are of a right barefoot, while FIGS. 10 & 12 are with running shoe.

DETAILED DESCRIPTION OF THE PREFERRED EMBODIMENTS

Figure 1:
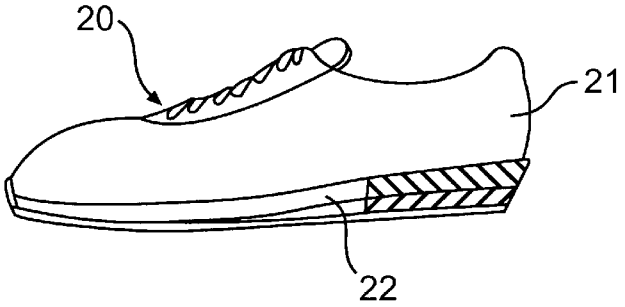
FIG. 1 PRIOR ART
FIG. 1 is a perspective view of a typical shoe, specifically an athletic running shoe known to the prior art to which the invention is applicable.

FIG. 1 shows a perspective view of a shoe, such as an athletic shoe in the form of a typical running shoe, according to the prior art, wherein the running shoe 20 includes an upper portion 21 and a sole 22.

Figure 2:
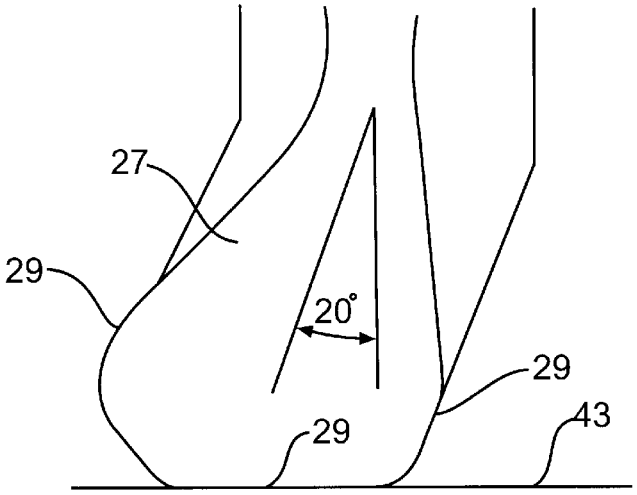
FIG. 2 shows, in frontal plane cross section at the heel, the human foot when tilted 20 degrees outward, at the normal limit of ankle inversion.

FIG. 2 shows a similar heel cross section of a barefoot tilted outward laterally at the normal 20 degree inversion maximum. In marked contrast to FIG. 1, FIG. 2 demonstrates that such normal tilting motion in the barefoot is accompanied by a very substantial amount of flattening deformation of the human foot sole, which has a pronounced rounded contour when unloaded.

FIG. 2 shows that in the critical heel area the barefoot maintains almost as great a flattened area of contact with the ground when tilted at its 20 degree maximum as when upright.

Figure 3:
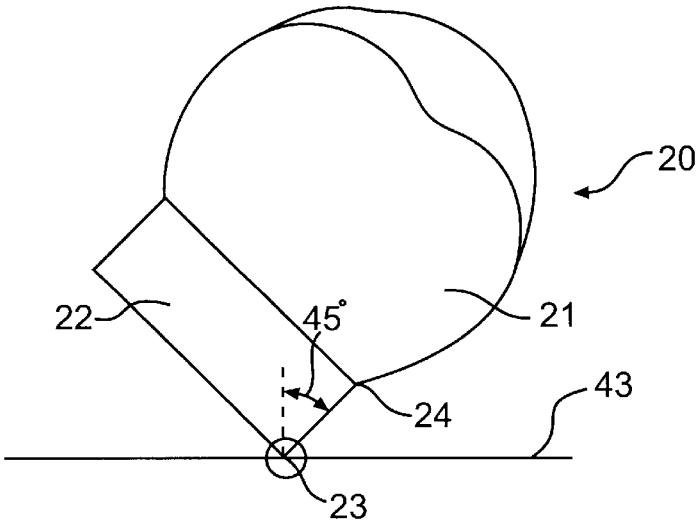
FIG. 3 PRIOR ART
FIG. 3 shows, in frontal plane cross section at the heel portion of a shoe, a conventional modern running shoe with rigid heel counter and reinforcing motion control device and a conventional shoe sole.

FIG. 3 shows a conventional athletic shoe in cross section at the heel, with a conventional shoe sole 22. FIG. 3 specifically illustrates when that shoe is tilted outward laterally in 45 degrees of inversion motion, which is past the normal natural limit of such motion in the barefoot.

In complete contrast to the barefoot, FIG. 3 indicates clearly that the conventional shoe sole changes in an instant from an area of contact with the ground 43 substantially greater than that of the barefoot, as much as 100 percent more when measuring in roughly the frontal plane, to a very narrow edge only in contact with the ground, an area of contact many times less than the barefoot. The unavoidable consequence of that difference is that the conventional shoe sole is inherently unstable and interrupts natural foot and ankle motion, creating a high and unnatural level of injuries, traumatic ankle sprains in particular and a multitude of chronic overuse injuries.

This critical stability difference between a barefoot and a conventional shoe has been dramatically demonstrated in the applicant's new and original ankle standing sprain simulation test described in detail in the applicant's earlier U.S. patent application Ser. No. 07/400,714, filed on Aug. 30, 1989 and was referred to also in both of his earlier applications previously noted here.

FIG. 3 demonstrates that the conventional shoe sole 22 functions as an essentially rigid structure in the frontal plane, maintaining its essentially flat, rectangular shape when tilted and supported only by its outside, lower corner edge 23, about which it moves in rotation on the ground 43 when tilted. The structural rigidity of most conventional street shoe materials alone, especially in the critical heel area, is usually enough to effectively prevent deformation, but they are often supplemented with strong heel counters and motion control devices.

Figure 4:
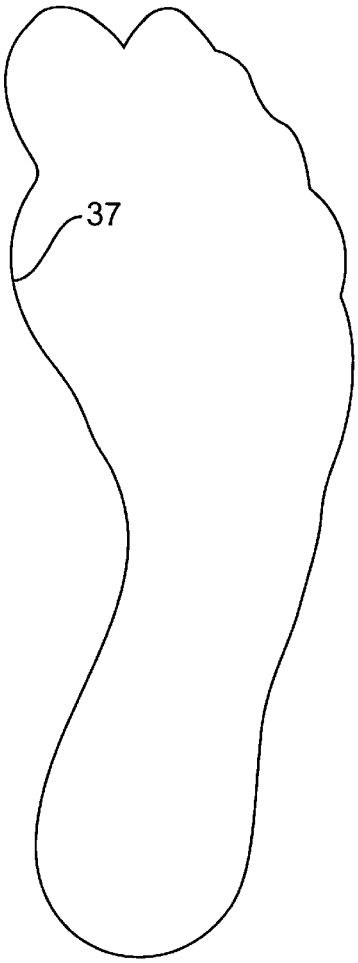
FIGS. 4–4B show the footprints of the natural barefoot sole and shoe sole.
Figure 4A:
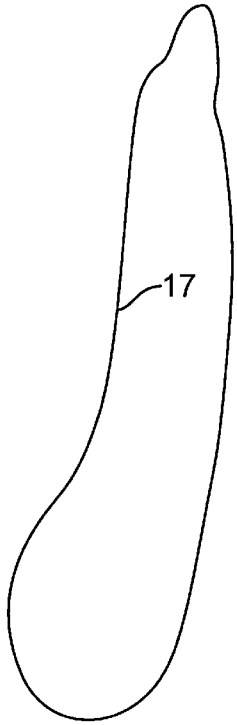
FIG. 4A shows the foot tilted out 20 degrees to about its normal limit.
Figure 4B:
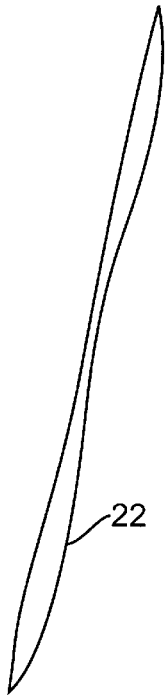

FIGS. 4–4B show the footprints of the natural barefoot sole and shoe sole. The footprints are the areas of contact between the bottom of the foot or shoe sole and the flat, horizontal plane of the ground, under normal body weight-bearing conditions. FIG. 4 shows a typical right footprint outline 37 when the foot is upright with its sole flat on the ground FIG. 4A shows the footprint outline 17 of the same foot when tilted out 20 degrees to about its normal limit; this footprint corresponds to the position of the foot shown in FIG. 2. Critical to the inherent natural stability of the barefoot is that the area of contact between the heel and the ground is virtually unchanged, and the area under the base of the fifth metatarsal and cuboid is narrowed only sightly. Consequently, the barefoot maintains a wide base of support even when tilted to its most extreme lateral position.

The major difference shown in FIG. 4A is clearly in the forefoot, where all of the heads of the first through fourth metatarsals and their corresponding phalanges no longer make contact with the ground. Of the forefoot, only the head of the fifth metatarsal continues to make contact with the ground, as does its corresponding phalange, although the phalange does so only slightly. The forefoot motion of the forefoot is relatively great compared to that of the heel.

Figure 5:
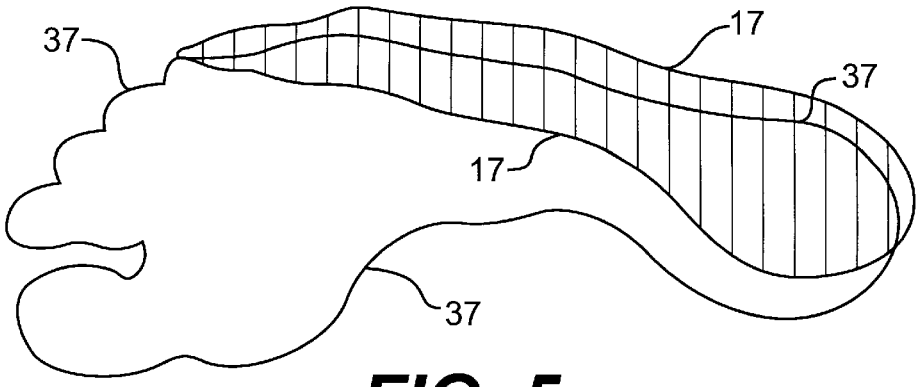
FIG. 5 shows footprints like FIGS. 4 and 4A of a right barefoot upright and tilted out 20 degrees, but showing also their actual relative positions to each other as a high arched foot rolls outward from upright to tilted out 20 degrees.

FIG. 4B shows a shoe sole print outline of a shoe sole of the same size as the barefoot in FIGS. 4 & 4A when tilted out 20 degrees to the same position as FIG. 4A; this position of the shoe sole corresponds to that shown in FIG. 3. The shoe sole maintains only a very narrow bottom edge in contact with the ground, an area of contact many times less than the barefoot FIG. 5 shows two footprints like footprint 37 in FIG. 4 of a barefoot upright and footprint 17 in FIG. 4A of a barefoot tilted out 20 degrees, but showing also their actual relative positions to each other as the foot rolls outward from upright to tilted out 20 degrees. The barefoot tilted footprint is shown hatched. The position of tilted footprint 17 so far to the outside of upright footprint 37 demonstrates the requirement for greater shoe sole width on the lateral side of the shoe to keep the foot from simply rolling off of the shoe sole; this problem is in addition to the inherent problem caused by the rigidity of the conventional shoe sole. The footprints are of a high arched foot.

Figure 6:
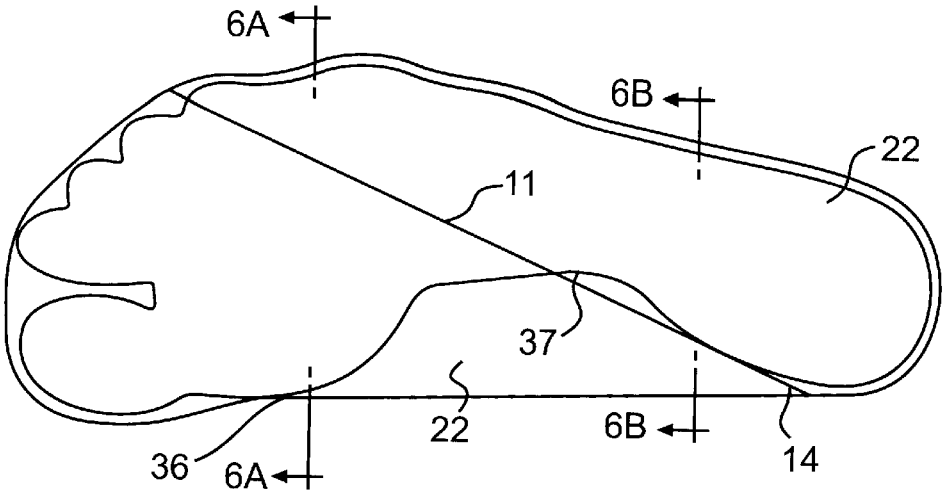
FIGS. 6–6C show the applicant's invention of a shoe sole with a lateral stability sipe in the form of a vertical slit.
Figure 6A:
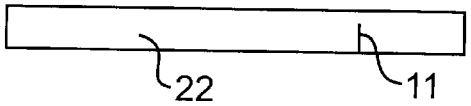
FIG. 6B is a cross section about the forefoot of the shoe sole with lateral stability sipe.
Figure 6B:
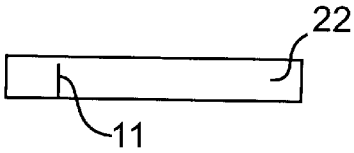
Figure 6C:
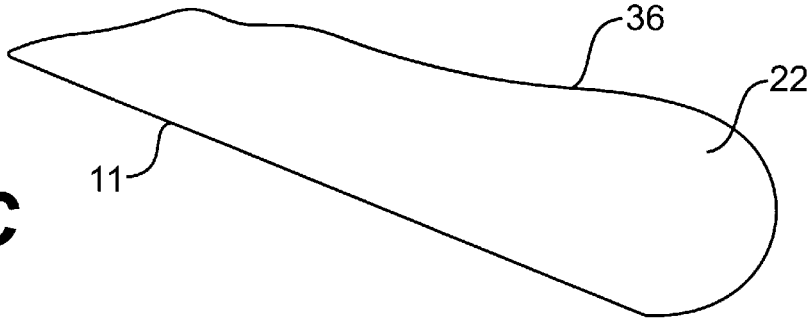

FIGS. 6–6C show the applicant's invention of shoe sole with a lateral stability sipe 11 in the form of a vertical slit. The lateral stability sipe allows the shoe sole to flex in a manner that parallels the foot sole, as seen is FIGS. 4 & 5. The lateral stability sipe 11 allows the forefoot of the shoe sole to pivot off the ground with the wear's forefoot when the wearer's foot rolls out laterally. At the same time, and most critically, it allows the remaining shoe sole to remain flat on the ground under the wearer's load-bearing tilted footprint 17 in order to provide a firm and natural base of structural support to the wearer's heel, his fifth metatarsal base and head, as well as cuboid and fifth phalange and associated softer tissues. In this way, the lateral stability sipe provides the wearer of even a conventional shoe sole with lateral stability like that of the barefoot. All shoes can be distinctly improved with this invention, even women's high heeled shoes.

With the lateral stability sipe, the natural supination of the foot, which is its outward rotation during load-bearing, can occur with greatly reduced obstruction. The functional effect is analogous to providing a car with independent suspension, with the axis aligned correctly. At the same time, the principle load-bearing structures of the foot are firmly supported with no sipes directly underneath.

FIG. 6 is a top view of a conventional shoe sole with a corresponding outline of the wearer's footprint superimposed on it to identify the position of the lateral stability sipe 11, which is fixed relative to the wearer's foot, since it removes the obstruction to the foot's natural lateral flexibility caused by the conventional shoe sole.

With the lateral stability sipe 11 in the form of a vertical slit, when the foot sole is upright and flat, the shoe sole provides firm structural support as if the sipe were not there. No rotation beyond the flat position is possible with a ripe in the form of a slit, since the shoe sole on each side of the slit prevents further motion.

Many variations of the lateral stability sipe 11 are possible to provide the same unique functional goal of providing shoe sole flexibility along the general axis shown in FIG. 6. For example, the slit can be of various depths depending on the flexibility of the shoe sole material used; the depth can be entirely through the shoe sole, so long as some flexible material acts as a joining hinge, like the cloth of a fully lasted shoe, which covers the bottom of the foot sole, as well as the sides. The slits can be multiple, in parallel or askew. They can be offset from vertical. They can be straight lines, jagged lines, curved lines or discontinuous lines.

Although slits are preferred, other sipe forms such as channels or variations in material densities as described in the applicant's earlier '509, '579, and '870 applications can also be used, though many such forms will allow varying degrees of further pronation rotation beyond the flat position, which may not be desirable, at least for some categories of runners. Other methods in the existing art can be used to provide flexibility in the shoe sole similar to that provided by the lateral stability sipe along the axis shown in FIG. 6.

The axis shown in FIG. 6 can also vary somewhat in the horizontal plane. For example, the footprint outline 37 shown in FIG. 6 is positioned to support the heel of a high arched foot; for a low arched foot tending toward excessive pronation, the medial origin 14 of the lateral stability sipe would be moved forward to accommodate the more inward or medial position of pronator's heel. The axis position can also be varied for a corrective purpose tailored to the individual or category of individual: the axis can be moved toward the heel of a rigid, high arched foot to facilitate pronation and flexibility, and the axis can be moved away from the heel of a flexible, low arched foot to increase support and reduce pronation.

It should be noted that various forms of firm heel counters and motion control devices in common use can interfere with the use of the lateral stability sipe by obstructing motion along its axis; therefore, the use of such heel counters and motion control devices should be avoided.

The lateral stability sipe may also compensate for shoe heel-induced outward knee cant.

FIGS. 6A and 6B are cross sections of the shoe sole 22 with lateral stability sipe 11. The shoe sole thickness is constant but could vary as do many conventional and unconventional shoe soles known to the art. The shoe sole could be conventionally flat like the ground or conform to the shape of the wearer's foot, as introduced in the applicant's '667 application, now U.S. Pat. No. 5,317,819, issued Jun. 7, 1994 and subsequent applications, all of which have been published by the World Intellectual Property Organization.

FIG. 6C is a top view like FIG. 6, but showing the print of the shoe sole with a lateral stability sipe when the shoe sole is tilted outward 20 degrees, so that the forefoot of the shoe sole is not longer in contact with the ground, while the heel and the lateral section do remain flat on the ground.

Figure 7:
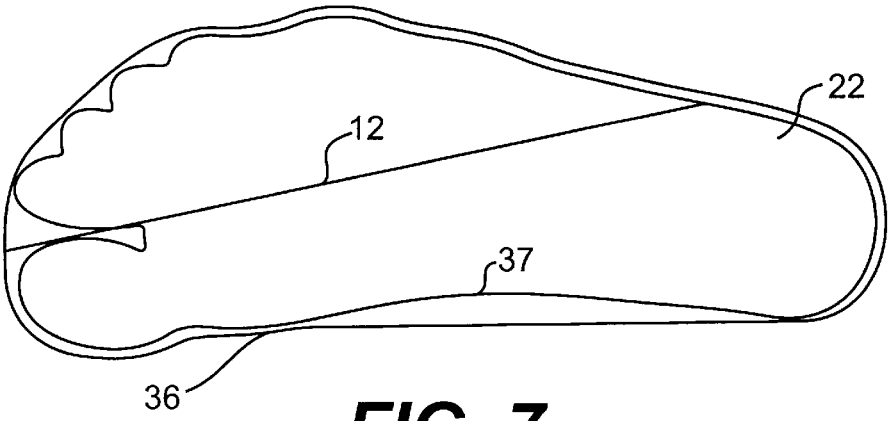
FIG. 7 shows a medial stability sipe that is analogous to the lateral sipe, but to provide increased pronation stability; the head of the first metatarsal and the first phalange are included with the heel to form a medial support section.

FIG. 7 shows a conventional shoe sole with a medial stability sipe 12 that is like the lateral sipe 11, but with a purpose of providing increased medial or pronation stability instead of lateral stability; the head of the first metatarsal and the first phalange are included with the heel to form a medial support section inside of a flexibility axis 12. The medial stability sipe 12 can be used alone, as shown, or together with the lateral stability sipe 11, which is not shown.

Figure 8:
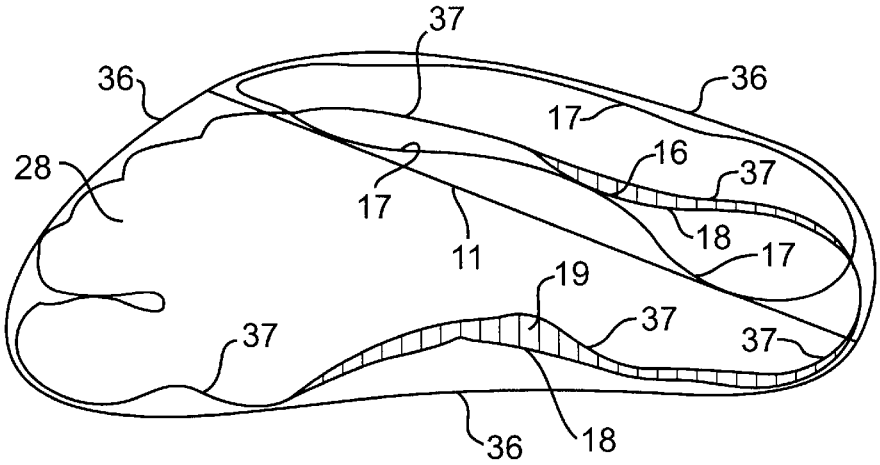
FIG. 8 shows a footprints 37 and 17, like FIG. 5, of a right barefoot upright and tilted out 20 degrees, showing the actual relative positions to each other as a low arched foot rolls outward from upright to tilted out 20 degrees.

FIG. 8 shows footprints 37 and 17, like FIG. 5, of a right barefoot upright and tilted out 20 degrees, showing the actual relative positions to each other as a low arched foot rolls outward from upright to tilted out 20 degrees. The low arched foot is particularly noteworthy because it exhibits a wider range of motion than the FIG. 5 high arched foot, so the 20 degree lateral tilt footprint 17 is farther to the outside of upright footprint 37. In addition, the low arched foot pronates inward to inner footprint borders 18; the hatched area 19 is the increased area of the footprint due to the pronation, whereas the hatch area 16 is the decreased area due to pronation.

In FIG. 8, the lateral stability sipe 11 is clearly located on the shoe sole along the inner margin of the lateral footprint 17 superimposed on top of the shoe sole and is straight to maximize ease of flexibility.

A shoe sole of extreme width is necessitated by the common foot tendency toward excessive pronation, as shown in FIG. 8, in order to provide structural support for the full range of natural foot motion, including both pronation and supination. Extremely wide shoe soles are most practical if the sides of the shoe sole are not flat as is conventional but rather are bent up to conform to the natural shape of the shoe wearer's foot sole in accordance with the applicant's '667, now U.S. Pat. No. 5,317,819, issued Jun. 7, 1994 and later pending applications, all of which have been published by the World Intellectual Property Organization.

Figure 10:
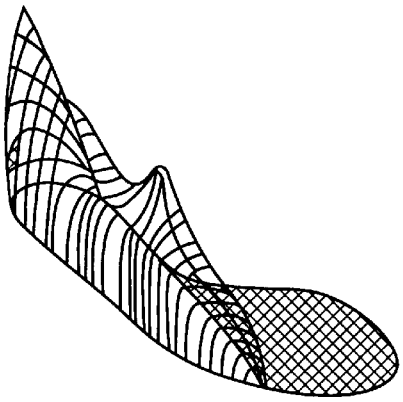
Figure 11:
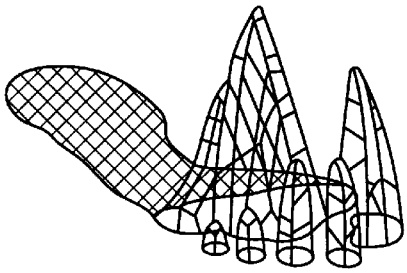
Figure 12:
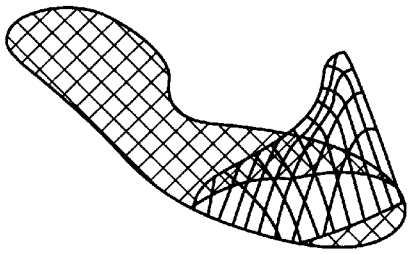
Figure 13:
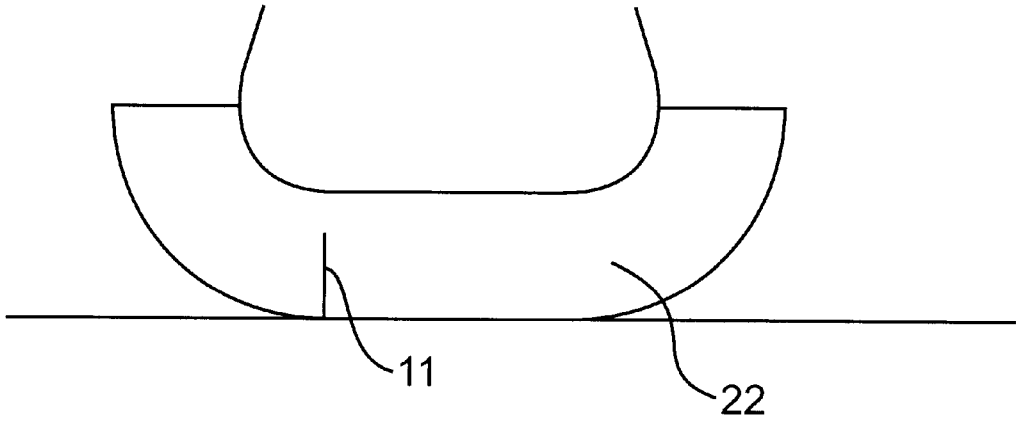
FIG. 13 shows a shoe sole with a lateral stability sipe and bent up sides to conform to the natural shape of the wearer's foot sole.

FIG. 10 shows a shoe sole 22 with a slit 11 and a side bent up to conform to the natural shape of the wearer's foot sole.

Figure 9:
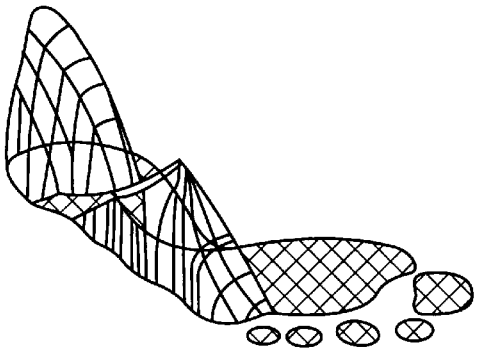
FIGS. 9–12 show pressure distribution measurements taken during running for a runner barefoot and with running shoes.

FIG. 9 shows pressure distribution measurements taken during running for a runner barefoot and with running shoes. FIGS. 9 A & C are of a right barefoot, while FIGS. 9 B & D are with running shoe.

FIGS. 9 A & B were taken early in the load-bearing phase of the running stride and the areas of pressure shown coincide with the area encompassed by the lateral tilt footprint 17. FIGS. 9 C & D were taken late in the same phase and the areas of pressure shown occur in the remaining load-bearing portion of the footprint area 37. Both sets of Figs. coincide with general areas of peak loads focused on specific points, which would tend to unbalance the shoe sole. It is anticipated that the lateral stability sipe invention will serve to reduce these peak point loads by better distributing the pressure to broader areas, increasing stability thereby. Since the lateral stability sipe is not located underneath the two areas of peak pressure points, but rather between them, it should be able to provide firm structure support to those areas, so that the functional characteristics of existing conventional shoe soles is not alterred a great deal, except as intended by the invention.

Note that the head of the fifth metatarsal and the fifth phalange are functionally part of both areas and are the only structural elements of the foot that are mutual to both areas.

Finally, the design of shank support should be modified according to the applicant's invention, so that natural flexibility along the axis of the lateral stability sipe 11 is provided, instead of obstructed, as do existing shank designs.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A shoe sole, comprising:

a shoe sole having a load-bearing portion, including a side portion, proximate to at least one of the following bones of a wearer's foot: a head of a fifth metatarsal; a base of a fifth metatarsal; a lateral tuberosity of a calcaneus; a base of a calcaneus; a head of a first metatarsal; and a head of a first distal phalange;

said load-bearing portion of the shoe sole has a width that provides structural support for said at least one wearer's foot bone throughout at least a full range of said wearer's pronation and supination foot motion on the ground, including extreme pronation and extreme supination;

said load-bearing side portion is bent up toward a sole of the wearer's foot proximate to said at least one wearer's foot bone;

said load-bearing side portion has a lower surface, which becomes ground-contacting during sideways motion of said shoe sole on the ground; and wherein said shoe sole has a hinge including at least one lateral stability sipe and said at least one lateral stability sipe is oriented substantially in a longitudinal direction, originates on a sole side of an area of the shoe sole corresponding to a wearer's heel, and terminates at a forefoot area of the shoe sole on a sole side opposite the originating sole side.

2. The shoe sole as set forth in claim 1, wherein said load-bearing portion, including said side portion, substantially conforms to the shape of the wearer's foot sole proximate to said wearer's foot bone.

3. The shoe sole as set forth in claim 1, wherein the thickness of the shoe sole has variation when seen in a sagittal plane cross section.

4. The shoe sole as set forth in claim 1, wherein said at least one lateral stability sipe originates on a medial side of the shoe sole and terminates at an area on the shoe sole corresponding to a wearer's fifth phalange.

5. The shoe sole as set forth in claim 1, wherein said at least one lateral stability sipe is a substantially vertical slit as viewed in a frontal plane cross-section of the shoe sole in a shoe upright condition.

6. The shoe sole as set forth in claim 1, wherein said at least one lateral stability sipe extends into at least a part of said bent up portion.

7. A shoe sole, comprising:

a shoe sole having a load-bearing portion, including a side portion, proximate to at least one of the following bones of a wearer's foot: a head of a fifth metatarsal; a base of a fifth metatarsal; a lateral tuberosity of a calcaneus; a base of a calcaneus; a head of a first metatarsal; and a head of a first distal phalange;

said load-bearing portion of the shoe sole has a width that provides structural support for said at least one wearer's foot bone throughout at least a full range of said wearer's pronation and supination foot motion on the ground, including extreme pronation and extreme supination;

said load-bearing side portion is bent up toward a sole of the wearer's foot proximate to said at least one wearer's foot bone;

said load-bearing side portion has a lower surface, which becomes ground-contacting during sideways motion of said shoe sole on the ground;

wherein said shoe sole has a hinge including at least one lateral stability sipe and said at least one lateral stability sipe is oriented substantially in a longitudinal direction, originates on a sole side of an area of the shoe sole corresponding to a wearer's heel, and terminates at a forefoot area of the shoe sole on a sole side opposite the originating sole side; and wherein said sole includes only one sipe.

8. The shoe sole as set forth in claim 7, wherein said at least one lateral stability sipe originates on a medial side of the shoe sole and terminates at an area on the shoe sole corresponding to a wearer's fifth phalange.

9. The shoe sole as set forth in claim 7, wherein said at least one lateral stability sipe is a substantially vertical slit as viewed in a frontal plane cross-section of the shoe sole in a shoe upright condition.

10. The shoe sole as set forth in claim 7, wherein said at least one lateral stability sipe extends into at least a part of said bent up portion.

11. A shoe sole, comprising:

a shoe sole having a load-bearing portion, including a side portion, approximate to at least one of the following bones of a wearer's foot: a head of a fifth metatarsal; a base of a fifth metatarsal; a lateral tuberosity of a calcaneus; a base of a calcaneus; a head of a first metatarsal; and a head of a first distal phalange;

said load-bearing portion of the shoe sole has a width that provides structural support for said at least one wearer's foot bone throughout at least a full range of said wearer's pronation and supination foot motion on the ground, including extreme pronation and extreme supination;

said load-bearing side portion is bent up toward a sole of the wearer's foot proximate to said at least one wearer's foot bone;

said load-bearing side portion has a lower surface, which becomes ground-contacting during sideways motion of said shoe sole on the ground; and wherein said shoe sole has a hinge including at least one lateral stability sipe and said at least one lateral stability sipe is oriented substantially in a longitudinal direction, originates on a sole side of an area of the shoe sole corresponding to a wearer's heel, and terminates at a forefoot area of the shoe sole on a sole side opposite the originating sole side; and wherein said at least one lateral stability sipe penetrates most of the thickness of said shoe sole.

12. The shoe sole as set forth in claim 11, wherein said at least one lateral stability sipe originates on a medial side of the shoe sole and terminates at an area on the shoe sole corresponding to a wearer's fifth phalange.

13. The shoe sole as set forth in claim 11, wherein said at least one lateral stability sipe is a substantially vertical slit as viewed in a frontal plane cross-section of the shoe sole in a shoe upright condition.

14. The shoe sole as set forth in claim 11, wherein said at least one lateral stability sipe extends into at least a part of said bent up portion.

* * * * *